United States Patent [19]

Murata

[11] Patent Number: 4,820,685

[45] Date of Patent: Apr. 11, 1989

[54] TRANSFER SHEETS FOR THERMAL TRANSFER RECORDING

[76] Inventor: Yukichi Murata, 8-26, Miyashita-honcho 3-chome, Sagamihara-shi, Kanagawa, Japan

[21] Appl. No.: 146,420

[22] Filed: Jan. 21, 1988

[30] Foreign Application Priority Data

Jan. 23, 1987 [JP] Japan ..... 62-13649
Jan. 31, 1987 [JP] Japan ..... 62-20872

[51] Int. Cl.[4] ..... B41M 5/035; B41M 5/26

[52] U.S. Cl. ..... 503/227; 8/471; 428/216; 428/480; 428/913; 428/914

[58] Field of Search ..... 8/470, 471; 427/146, 427/256; 428/195, 480, 913, 914, 212, 216, 335, 336; 430/200, 201, 945; 503/227

[56] References Cited

U.S. PATENT DOCUMENTS 3,023,213 2/1962 Richter ..... 546/110

FOREIGN PATENT DOCUMENTS

0208211A2 1/1987 European Pat. Off. ..... 8/675
0053565 3/1985 Japan ..... 503/227
2159971 12/1985 United Kingdom ..... 503/227

*Primary Examiner*—Bruce H. Hess
*Attorney, Agent, or Firm*—Jordan B. Bierman

[57] ABSTRACT

A transfer sheet having on a base film a color material layer containing a quinophthalone series dye of formula (I) and/or a quinophthalone series dye of formula (II), which is used for a sublimation type thermal transfer system:

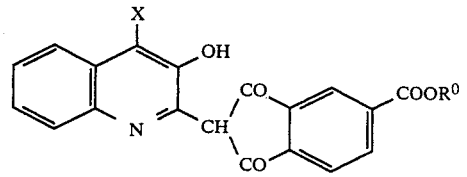

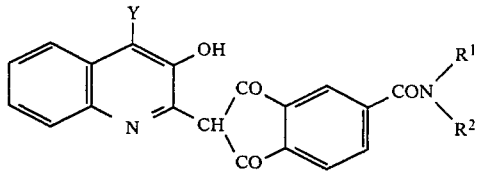

wherein X represents a hydrogen atom or a halogen atom; $R^0$ represents an alkyl group, an alkoxyalkyl group which may be substituted, an aralkyloxyalkyl group which may be substituted, an allyloxyalkyl group which may be substituted, an aryloxyalkyl group, a tetrahydrofurfuryl group, a furfuryl group, a cycloalkyl group, an allyl group, or an aralkyl group; Y represents a hydrogen atom or a halogen atom; and $R^1$ and $R^2$ represent a hydrogen atom, an alkyl group, an alkoxyalkyl group, a cycloalkyl group, an allyl group, an aryl group which may be substituted, an aryl group, an aralkyl group, a furfuryl group, a tetrahydrofurfuryl group, or a hydroxyalkyl group.

14 Claims, No Drawings

TRANSFER SHEETS FOR THERMAL TRANSFER RECORDING

FIELD OF THE INVENTION

This invention relates to a transfer sheet which is used for sublimation type thermal transfer recording. More specifically, the invention relates to a sublimation type thermal transfer sheet of yellow color.

BACKGROUND OF THE INVENTION

Hitherto, a technique of recording color images in facsimile printers, copying machines, televisions, etc., has been desired and color recording techniques by electrophotography, ink jet printing, thermal transfer recording, etc., have been investigated.

A thermal transfer system is considered to be advantageous as compared with other systems since in the thermal transfer recording system, the management and operation of the apparatus can be easily performed and also the apparatus and supplies for the apparatus are inexpensive.

For the thermal transfer system, there are a melt system of heating a transfer sheet having a heat-melting ink layer formed on a base film by a thermal head to melt the ink and transfer-recording the ink on a recording material and a sublimation system of heating a transfer sheet having an ink layer containing sublimable dyes formed on a base film to sublime the dye and transfer-recording onto a recording material.

Since in the sublimation system, the sublimed and transferred amount of dyes can be controlled by changing the energy applied to a thermal head, gradation recording can be easily performed and hence the system is considered to be particularly advantageous for full color recording.

In thermal transfer recording of the sublimation system, the sublimable dye(s) which is used for the transfer sheet are very important since they give large influences on the speed of transfer recording, the image quality of recorded images, the storage stability of images formed and are required to satisfy the following factors:

(1) The dye easily sublime by the working condition of an ordinary heating means such as thermal recording head.

(2) The dye does not cause thermal decomposition under the working condition of a thermal recording head before subli- mation.

(3) The dye has a preferred hue for color reproduction.

(4) The dye has a large molecular extinction coefficient.

(5) The dyes are stable to heat, light, moisture, chemicals, etc.

(6) The dye can be easily synthesized.

(7) The dye has an excellent ink-forming aptitude.

(8) The dye gives no problems on safety and hygiene.

SUMMARY OF THE INVENTION

The object of this invention is, therefore, to provide a sublimation type thermal transfer sheet having a color material layer containing yellow dye(s) satisfying the above-described factors.

That is, the invention is a thermal transfer recording sheet having on one surface of a base film a color material layer containing sublimable dye(s) together with a binder, wherein said color material layer contains a quinophthalone series dye represented by the following formula (I) and/or a quinophthalone series dye represented by the following formula (II):

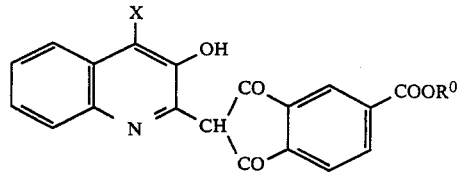

(I)

wherein X represents a hydrogen atom or a halogen atom and $R^0$ represents an alkyl group, an alkoxyalkyl group which may be substituted, an aralkyloxyalkyl group which may be substituted, an allyloxyalkyl group which may be substituted, an aryloxyalkyl group which may be substituted, a tetrahydrofurfuryl group, a furfuryl group, a cycloalkyl group, an allyl group, or an aralkyl group.

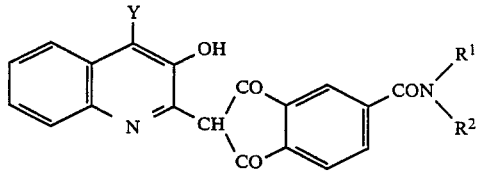

(II)

wherein Y represents a hydrogen atom or a halogen atom and $R^1$ and $R^2$, which may be the same or different, each represents a hydrogen atom, an alkyl group, an alkoxyalkyl group, a cycloalkyl group, an allyl group, an aryl group which may be substituted, an aralkyl group, a furfuryl group, a tetrahydrofurfuryl group, or a hydroxyalkyl group.

DETAILED DESCRIPTION OF THE INVENTION

Then, the invention is explained in detail.

First, the quinophthalone series dyes shown by formula (I) described above are explained.

As the alkyl group shown by $R^0$ in formula (I) described above, there are straight chain or branched alkyl groups having from 1 to 12 carbon atoms, such as a methyl group, an ethyl group, a propyl group, a butyl group, a pentyl group, a hexyl group, a heptyl group, an octyl group, a decyl group, a dodecyl group, etc.

As the alkoxyalkyl group, which may be substituted, shown by $R^0$, there are a 2-methoxyethyl group, a 2-ethoxyethyl group, a 2-n-propoxyethyl grouo, a 2-iso-propoxyethyl group, a 2-n-butoxyethyl group, a 2-iso-butoxyethyl group, a 2-sec-butoxyethyl group, a 2-n-pentyloxyethyl group, a 2-n-hexyloxyethyl group, a 2-n-octyloxyethyl group, a 2-(2-ethylhexyloxy)ethyl group, a 1-methyl-2-methoxyethyl group, a 1-methyl-2-ethoxyethyl group, a 1-methyl-2-n-propoxyethyl group, a 1-methyl-2-iso-propoxyethyl group, a 1-methyl-2-n-butoxyethyl group, a 1-methyl-2-iso-butoxyethyl group, a 1-methyl-2-n-hexyloxyethyl group, a 1-methyl-2-(2-ethylhexyloxy)ethyl group, a 3-methoxybutyl group, a 3-ethoxybutyl group, a 1-ethyl-2-methoxyethyl group, a 1-ethyl-2-ethoxyethyl group, etc. In these groups, $\beta$-alkoxyethyl groups having from 3 to 8 carbon atoms are very preferred.

As the aralkyloxyalkyl group, which may be substituted, shown by $R^0$, there are a 2-benzyloxyethyl group, a 1-methyl-2-benzyloxyethyl group, a 1-ethyl-2-benzyloxyethyl group, a 2-(β-phenylethyl)oxyethyl group, etc.

As the allyloxyalkyl group, which may be substituted, shown by $R^0$, there are a 2-allyloxyethyl group, a 1-methyl-2-allyloxyethyl group, a 1-ethyl-2-allyloxyethyl group, etc.

As the aryloxyalkyl group, which may be substituted, shown by $R^0$, there are a 2-phenoxyethyl group, a 1-methyl-2-phenoxyethyl group, a 1-ethyl-2-phenoxyethyl group, etc.

As the cycloalkyl group shown by $R^0$, there are a cyclopentyl group, a cyclohexyl group, etc.

As the aralkyl group shown by $R^0$, there are a benzyl group, a 2-phenylethyl group, etc.

Also, as the halogen atom shown by X in formula (I), there are a chlorine atom and a bromine atom.

In the preferred quinophthalone series dyes shown by formula (I), $R^0$ is an alkyl group having from 4 to 12 carbon atoms and X is a hydrogen atom or a bromine atom and in the more preferred quinophthalone dyes, $R^0$ is an alkyl group having from 6 to 8 carbon atoms and X is a hydrogen atom.

Then, the quinophthalone series dyes shown by formula (II) described above are explained in detail.

As the halogen atom shown by Y in formula (II), there are a chlorine atom and a bromine atom.

As the alkyl group shown by $R^1$ and $R^2$ in formula (II), there are straight chain or branched alkyl groups having from 1 to 8 carbon atoms, such as a methyl group, an ethyl group, a propyl group, a butyl group, a pentyl group, a hexyl group, a heptyl group, an octyl group, etc.

As the alkoxyalkyl group shown by $R^1$ and $R^2$, there are alkoxyalkyl groups having from 2 to 8 carbon atoms, such as a 2-methoxyethyl group, a 2-ethoxyethyl group, a 2-n-propoxyethyl group, a 2-iso-propoxyethyl group, a 2-n-butoxyethyl group, a 2-iso-butoxyehyl group, a 2-sec-butoxyethyl group, a 3-methoxypropyl group, a 3-ethoxypropyl group, a 3-n-propoxypropyl group, a 3-iso-propoxypropyl group, a 3-n-butoxypropyl group, a 3-iso-butoxypropyl group, a 3-sec-butoxypropyl group, etc.

As the aralkyl group shown by $R^1$ and $R^2$, there are aralkyl groups having 7 or 8 carbon atoms, such as a benzyl group, a 2-phenylethyl group, etc.

As the cycloalkyl group shown by $R^1$ and $R^2$, there are a cyclopentyl group, a cyclohexyl group, etc.

As the aryl group shown by $R^1$ and $R^2$, there are substituted or unsubstituted aryl groups and examples of the substituted aryl group are phenyl groups having substituent such as a lower alkyl group (e.g., a methyl group, an ethyl group, a butyl group, etc.), a lower alkoxy group (e.g., a methoxy group, an ethoxy group, a butoxy group, etc.), a halogen atom (e.g., a fluorine atom, a chlorine atom, a bromine atom, etc.), a trifluoromethyl group, etc.

As the hydroxyalkyl group shown by $R^1$ and $R^2$, there are hydroxy lower alkyl groups such as a 2-hydroxyethyl group, a 3-hydroxypropyl group, etc.

In the preferred quinophthalone series dyes shown by formula (II) described above, which are used for the transfer sheet of this invention, Y is a hydrogen atom or a bromine atom and $R^1$ and $R^2$ are a hydrogen atom or an alkyl group having from 1 to 8 carbon atoms.

In the more preferred quinophthalone dyes shown by formula (II), $R^1$ and $R^2$ are an alkyl group having from 1 to 4 carbon atoms, and in the particularly preferred dyes, Y is a bromine atom and $R^1$ and $R^2$ are an alkyl group having 3 or 4 carbon atoms.

In addition, the quinophthalone dyes shown by formulae (I) and (II) may be, if necessary, used together with the dyes shown by the same formulae having, however, different substituents. Furthermore, it is preferred that the dye shown by formula (I) and the dye shown by formula (II) are used together as a mixture thereof.

As a preferred combination of the dyes being used in the preferred case, there is a combination of the quinophthalone dye shown by formula (I), wherein X is a hydrogen atom or a bromine atom and $R^0$ is an alkyl group having from 4 to 12 carbon atoms and the quinophthalone dye shown by formula (II), wherein Y is a hydrogen atom or a bromine atom and $R^1$ and $R^2$ each represents a hydrogen atom or an alkyl group having from 1 to 8 carbon atoms.

A more preferred combination of the dyes is a combination of the quinophthalone dye shown by formula (I), wherein X is a hydrogen atom and $R^0$ is an alkyl group having from 6 to 8 carbon atoms and the quinophthalone dye shown by formula (II), wherein Y is a hydrogen atom or a bromine atom and $R^1$ and $R^2$ are an alkyl group having from 1 to 4 carbon atoms, and in particular Y is a bromine atom and $R^1$ and $R^2$ each is an alkyl group having 3 or 4 carbon atoms.

The quinophthalone series dyes shown by formula (I), which are used for the thermal transfer sheet of this invention, can be produced by, for example, the method described in Japanese Patent Application (OPI) No. 114439/85 (the term "OPI" as used herein referrs to a "published unexamined Japanese patent application").

Also, the quinophthalone series dyes shown by formula (II) can be produced by, for example, the methods described in U.S. Pat. No. 3,023,213 and West German Pat. No. 2,210,168.

Furthermore, if necessary, the above-described quinophthalone dye(s) in this invention may be used together with other dye(s) having different structure.

There is no particular restriction on the manner of applying the aforesaid dyes to the thermal transfer sheet of this invention. Usually, the dye(s) are dissolved or dispersion as in fine particles in a medium together with a binder to provide an ink and by coating the ink on a base film followed by drying, a color material layer is formed on a base film.

As the binder for preparing the ink for use in this invention, there are water-soluble resins such as cellulose series resins, acrylic acid series resins, starch series resins, etc., and organic solvent-soluble resins such as acrylic resins, methacrylic resins, polystyrene, polycarbonate, polysulfone, polyethersulfone, polyvinylbutyral, ethyl cellulose, acetylpropionyl cellulose, acetyl cellulose, AS resins, ABS resins, polyester resins, phenoxy resins, etc.

As the binder for use in this invention, a modified polycarbonate resin having a recuring structure unit represented by the following formula is preferred for forming a color material layer so that the transfer sheet obtained does not melt and adhesion to a recording sheet at transfer recording and sublimable dye(s) contained therein do not deposit on the sheet:

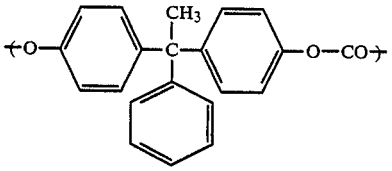

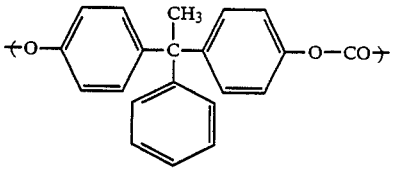

The modified polycarbonate resin described above has a glass transition temperature of from 160° C. to 230° C. and the concentration thereof in the ink is in the range of from 2 to 50% by weight, and preferably from 5 to 30% by weight.

As the medium for preparing the ink in this invention, there are water; alcohols such as methanol, isopropanol, iso-butanol, etc.; cellosolves such as methyl cellosolve, ethyl cellosolve, etc., aromatics such as toluene, xylene, chlorobenzene, etc.; esters such as ethyl acetate, butyl acetate, etc.; ketones such as acetone, methyl-ethyl ketone, methyl-isobutyl ketone, cyclohexanone, etc.; chlorine series solvents such as methylene chloride, chloroform, trichloroethylene, etc.; ethers such as tetrahydrofuran, dioxane, etc.; and other organic solvents such as N,N-dimethylformamide, N-methylpyrrolidone, etc.

The ink for use in this invention can, if necessary, contain other components such as organic or inorganic nonsublimable fine particles, a dispersing agent, an antistatic agent, an antiblocking agent, a defoaming agent, an antioxidant, a viscosity controlling agent, etc.

A base film on which the aforesaid ink is coated for preparing the thermal transfer sheet of this invention is required to satisfy the properties that the film is dense and thin for increasing the heat conductivity of the transfer sheet, has high heat resistance, can coat thereon a uniform transfer layer or color material layer, has good flatness for improving the intimate contact with a thermal head, and prevents the ink from oozing to the back surface thereof.

As such a base film, tissue papers such as condensor papers, glassine papers, etc., and films of plastics having good heat resistance, such as polyester, polycarbonate, polyamide, polyimide, polyaramide, etc., are suitable and the thickness thereof is in the range of from 3 to 50 μm.

In the above-described base films, a polyethylene terephthalate film is particularly advantageous in this invention from the view points of mechanical strength, solvent resistance, economy, etc.

The thermal transfer sheet of this invention is fundamentally composed of a base film and a color material layer containing the above-described dye(s) formed on the surface of the base film but as the case may be a heat-resisting slipping layer at the back side of the transfer sheet for improving the running property and the heat resistance thereof for a thermal head. Such a back layer is usually formed by coating additives such as a heat-resisting inactive inorganic compound (e.g., fine silica particles, etc.), and other additives such as a lubricant, a surface active agent, etc., together with a heat-resisting thermoplastic resin, a heat-resisting thermosetting resin, a heat-resisting photo-setting resin, etc.

For example, a polycarbonate resin having a recuring structure unit shown by the following formula is dissolved in a solvent such as toluene, etc., and the solution is coated on the back surface of the base film and dried to form the heat-resisting slipping layer. If necessary, a phosphoric acid ester series compound may be also preferably added to the polycarbonate resin. In other embodiment, the heat-resist slipping layer, etc. may be formed using a photo-setting acrylic resin, silicone oil, fine silica particles, etc.

In this invention, the ink containing the above-described quinophthalone series dye(s) can be coated on a base film by using a reversal roll coater, a gravure coater, a rod coater, an air doctor coater, etc. The dry thickness of the coated layer of the ink may be in the range of from 0.1 μm to 5 μm. Details of the coating methods are described in Yuji Harasaki, *Coating System*, published by Maki Shoten, 1979.

Also, if necessary, an adhesive layer composed of a polyester resin, an acrylic resin, an urethane resin, a polyvinyl alcohol resin, etc., singly or as a mixture thereof may be formed between the base film and the color material layer.

The quinophthalone series dyes shown by formula (I) and formula (II) described above have clear yellow color and are suitable for obtaining full color records having good color reproducibility by combining with suitable magenta dyes and cyan dyes. In this case, by using both the dyes of formulae (I) and (II) as a mixture thereof, more excellent effects are obtained.

Also, since the quinophthalone dyes for use in this invention are liable to sublime and have large molecular extinction coefficients, the use of these dyes can give records of high color density at high speed without giving large load to a thermal head. Furthermore, since the dyes are stable to heat, light, humidity, chemicals, etc., they do not cause thermal decomposition during transfer recording as well as the records obtained are excellent in storage stability, and particularly excellent in light resistance.

Furthermore, since the dyes have good solubility in organic solvent and good dispersibility in water, the ink containing uniformly dissolved or dispersed dyes at high concentration can be easily prepared and by using the ink, a thermal transfer sheet having the color material layer uniformly containing the dye(s) at high concentration can be obtained. Accordingly, by using the thermal transfer sheet, records having good uniformity and color density can be obtained.

Moreover, for the thermal transfer sheets of this invention, as the heating method, not only a thermal head but also infrared rays, laser light, etc., can be utilized.

The present invention is hereinafter described in greater detail with reference to examples, which are not to be construed as limiting the scope thereof.

EXAMPLE 1

(a) Preparation of Ink:

| | |
|---|---|
| Quinophthalone Series Dye of this invention shown below | 10 g |

-continued

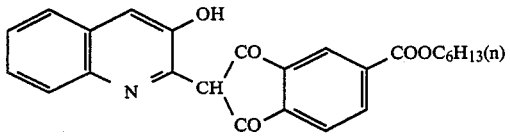

(Absorption maximum in acetone (λmax) = 439 n.m.)

| | |
|---|---|
| Cellulose Acetate (L-30, trade name, made by Daicel Chemical Industries, Ltd.) | 10 g |
| Methyl Ethyl Ketone | 80 g |
| Total | 100 g |

A mixture of the above components was treated by a paint conditioner for 10 minutes to provide an ink.

(b) Preparation of Transfer Sheet:

The ink described above was coated on a polyethylene terephthalate film of 6 μm in thickness, the back surface of which had been subjected to heat-resisting slipping treatment, using a wire bar at a dry thickness of about 1 μm and dried to provide a transfer sheet.

In addition, the heat resisting and slipping treatment for the polyethylene terephthalate film was carried out by coating a composition composed of 8 parts by weight of a polycarbonate resin having a recuring structure unit shown by the formula,

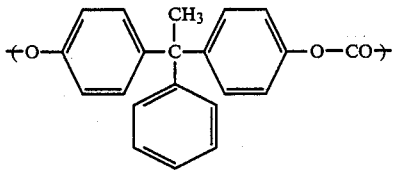

1 part by weight of a phosphorate ester series surface active agent (Prisurf A-208B, trade name, made by Daiichi Kogyo Seiyaku Co., Ltd.), and 91 parts by weight of toluene on the back surface of the film at a dry thickness of about 0.5 μm and drying.

(c) Preparation of Image-Receiving Element:

A coating composition composed of 10 parts (by weight) of a saturated polyester resin (TP-220, trade name, made by The Japan Synthetic Chemical Inuustry Co., Ltd.), 0.5 part of amino-modified silicone (KF 393, trade name, made by Sin-Etsu Chemical Co., Ltd.), 15 parts of methylethyl ketone, and 15 parts of xylene was coated on a synthetic paper (Yupo FPG-150, trade name, made by Oji Yuka K.K.) at a dry thickness of about 5 μm by means of a wire bar and the heat-treated on an oven for 30 minutes at 100° C. to provide an image-receiving element.

(d) Transfer Recording:

The above-described transfer sheet was superposed on the image-receiving element (recording material) so that the ink-coated surface was in contact with the image-receiving element and recording was carried out under the conditions shown below.

| Recording Conditions: | |
|---|---|
| Line density of main scanning and side scanning | 8 dots/mm |
| Recording electric power | 0.25 W/dot |
| Heating time of head | 10 msec. |

Thus, records of clear yellow color having a uniform color density of 1.69 could be obtained.

The color density was measured using a densitometer Type TR-927, made by Macbeth Co. in the United States.

When the records thus obtained were subjected to a light resistance test using a Carbon arc fade-o-meter (made by Suga Shikenki K.K.) (black panel temperature of 63° C.±2° C.), almost no discoloring and fading occurred after the irradiation for 40 hours. Also, the transfer sheet and the records obtained were stable to heat and humidity and thus were excellent in storage stability in the dark.

EXAMPLE 2

By following the same procedure as in Example 1 using dyes shown in Table 1 below in place of the dye in Example 1, inks were prepared and then the preparation of transfer sheets and transfer recording were carried out. By the results thereof, records of clear yellow color having the color densities shown in - Table 1 could be obtained.

The results of the light resistance test of the records obtained and the storage stability test in the dark of the transfer sheets and the records obtained were also good.

TABLE 1

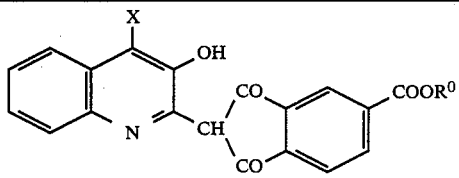

| No. | X | $R^0$ | Color density of Records | Max absorption of dye λmax (nm) |
|---|---|---|---|---|
| 2-1 | —H | $-C_2H_5$ | 0.99 | 439 |
| 2-2 | —H | $-C_4H_9(n)$ | 1.26 | " |
| 2-3 | —H | $-CH_2CH(C_2H_5)C_4H_9(n)$ | 1.82 | " |
| 2-4 | —H | $-CH_2CH_2OC_4H_9(n)$ | 1.57 | " |
| 2-5 | —H | $-CH_2CH_2OCH_2CH_2-$ 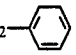 | 1.22 | " |
| 2-6 | —H | $-CH_2CH_2OCH_2-CH=CH_2$ | 1.55 | " |
| 2-7 | —H | $-CH_2CH_2O-$ 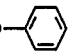 | 1.35 | " |
| 2-8 | —H | $-CH_2-$ 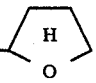 | 1.58 | " |
| 2-9 | —H | $-CH_2-$ 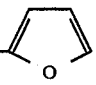 | 1.48 | " |
| 2-10 | —H | $-CH_2-CH=CH_2$ | 1.35 | " |
| 2-11 | —H | 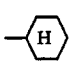 | 1.28 | " |
| 2-12 | —H | $-CH_2CH_2-$ 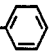 | 1.07 | " |
| 2-13 | —H | $-(CH_2)_2OCH_3$ | 1.48 | " |
| 2-14 | —H | $-C_{12}H_{25}(n)$ | 1.80 | " |
| 2-15 | —Br | $-C_6H_{13}(n)$ | 1.24 | " |
| 2-16 | —Br | $-C_8H_{17}(n)$ | 1.45 | " |

TABLE 1-continued

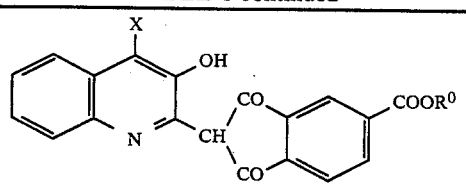

| No. | X | $R^0$ | Color density of Records | Max absorption of dye λmax (nm) |
|---|---|---|---|---|
| 2-17 | —Cl | $-C_5H_{11}(n)$ | 1.43 | " |
| 2-18 | —H | $-C_8H_{17}(n)$ | 1.80 | " |
| 2-19 | —H | $-C_5H_{11}(n)$ | 1.45 | " |

EXAMPLE 3

By following the same procedure as in Example 1 using the dye having the following structural formula in place of the dye used in Example 1, the preparation of the ink, the preparation of the transfer sheet and transfer recording were carried out. By the result thereof, records of clear yellow color having uniform color density of 1.40 could be obtained.

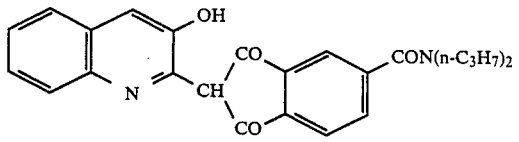

(Absorption maximum value in acetone (λmax)=441 n.m.)

As the results of performing a light-resistance test for the records obtained, it was confirmed that almost no discoloring and fading occurred after the irradiation for 40 hours.

The transfer sheet and the records obtained were excellent in the resistance to heat and humidity and thus in storage stability in the dark.

EXAMPLE 4

By following the same procedure as in Example 1 using the dyes shown in Table 2 below in place of the dye used in Example 1, inks were prepared and the preparation of transfer sheets and transfer recording were carried out, records of clear yellow color having color densities shown in Table 2 could be obtained.

The results of the light-resistance test of the records obtained and the storage stability test in the dark of the transfer sheets and the records were good.

TABLE 2

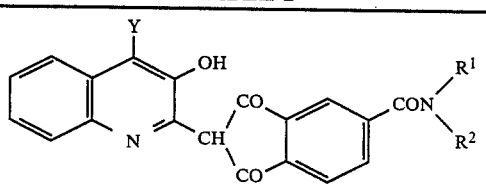

| No. | Y | $R^1$ | $R^2$ | Color density of Records | Max absorption of dye λmax (nm) |
|---|---|---|---|---|---|
| 4-1 | —H | $-C_2H_5$ | $-C_2H_5$ | 1.45 | 441 |
| 4-2 | —H | $-C_4H_9(n)$ | $-C_4H_9(n)$ | 1.38 | " |
| 4-3 | —Br | $-C_3H_7(n)$ | $-C_3H_7(n)$ | 1.27 | " |
| 4-4 | —Cl | $-C_3H_7(n)$ | $-C_3H_7(n)$ | 1.30 | " |
| 4-5 | —H | —H | $-C_6H_{13}(n)$ | 1.41 | " |
| 4-6 | —H | —H | $-CH_2CH(C_2H_5)C_4H_9(n)$ | 1.30 | " |
| 4-7 | —H | —H | $-(CH_2)_3OCH_3$ | 1.38 | " |
| 4-8 | —H | —H | 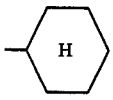 | 1.25 | " |
| 4-9 | —H | —H | $-CH_2-CH=CH_2$ | 1.40 | " |
| 4-10 | —H | —H | 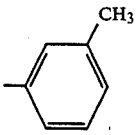 | 1.21 | " |
| 4-11 | —H | —H | 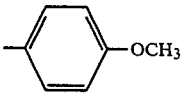 | 1.25 | " |

TABLE 2-continued

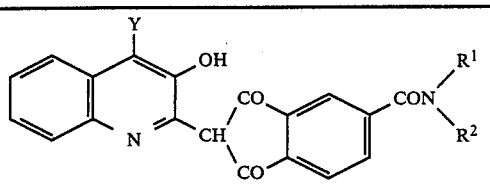

| No. | Y | $R^1$ | $R^2$ | Color density of Records | Max absorption of dye λmax (nm) |
|---|---|---|---|---|---|
| 4-12 | —H | —H | 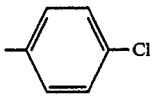 | 1.20 | " |
| 4-13 | —H | —H | 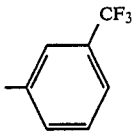 | 1.23 | " |
| 4-14 | —H | —H | 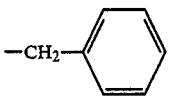 | 1.28 | " |
| 4-15 | —H | —H | 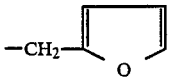 | 1.30 | " |
| 4-16 | —H | —H | 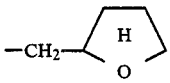 | 1.32 | " |
| 4-17 | —H | —H | $-CH_2CH_2OH$ | 1.21 | " |
| 4-18 | —H | —H | 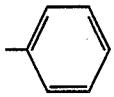 | 1.25 | " |
| 4-19 | —H | $-C_5H_{11}(n)$ | $-C_5H_{11}(n)$ | 1.35 | " |
| 4-20 | —Br | $-C_4H_9(n)$ | $-C_4H_9(n)$ | 1.45 | " |
| 4-21 | —Br | $-C_2H_5$ | $-C_2H_5$ | 1.25 | " |
| 4-22 | —Br | $-CH_2CH(C_2H_5)C_4H_9(n)$ | —H | 1.30 | " |

EXAMPLE 5

By following the same procedure as in Example 1 using the dyes (2-18) and (4-3) shown in Table 2 above in the following mixing composition in place of the dye used in Example 1, the preparation of ink and transfer sheet were performed.

| | |
|---|---|
| Dye No. 2-18 | 3.3 g |
| Dye No. 4-3 (1:2) | 6.7 g |
| Acetyl cellulose (L-30, trade name, made by Daicel Chemical Industries, Ltd.) | 10 g |
| Methyl ethyl ketone | 80 g |
| Total | 100 g |

Records were obtained under the following conditions using the transfer sheet thus prepared.

| Recording Conditions: | |
|---|---|
| Line density of main scanning and side scanning | 8 dots/mm |
| Recording electric power | 0.25 W/dot |
| Heating time of head | 10 msec. |

The color density of the record obtained measured by a densitometer Type TR-927 made by Macbeth Co. was 1.70. When the records obtained were subjected to a light-resistance test using a carbon arc fade-o-meter (made by Suga Shikenki K.K.) (at black panel temperature of 63° C.±2° C.), the extent of discoloring and fading [ΔE(L*a*b*)] after irradiation of 80 hours was 4.45.

Also, the transfer sheets and the records obtained were stable to heat and humidity and thus excellent in dark storage stability.

EXAMPLE 6

By following the same procedure as in Example 5 except that the compounding amount of dye (2-18) and dye (4-3) was changed to 2.5 g and 7.5 g, respectively (1:3), the preparation of the ink and transfer sheet and transfer recording were carried out, and by the result, record having color density of 1.70 were obtained. The light-resistance test result (ΔE) was 4.10.

While the invention has been described in detail and with reference to specific embodiments thereof, it will be apparent to one skilled in the art that various changes and modifications can be made therein without departing from the spirit and scope thereof.

What is claimed is:

1. A transfer sheet for thermal transfer recording system having on one surface of a base film a color material layer containing a binder and a sublimable dye, wherein said sublimable dye in the color material layer is a quinophthalone series dye represented by following formula (I) and/or a quinophthalone dye represented by following formula (II):

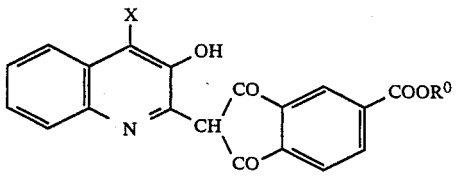

(I)

wherein X represents a hydrogen atom or a halogen atom and $R^0$ represents an alkyl group, an alkoxyalkyl group which may be substituted, an aralkyloxyalkyl group which may be substituted, an allyloxyalkyl group which may be substituted, an aryloxyalkyl group which may be substituted, a tetrahydrofurfuryl group, a furfuryl group, a cycloalkyl group, an allyl group, or an aralkyl group:

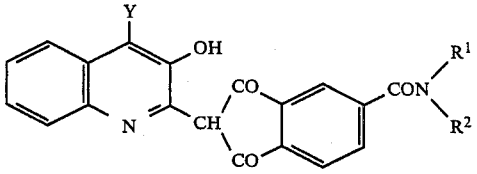

(II)

wherein Y represents a hydrogen atom or a halogen atom and $R^1$ and $R^2$ each represents a hydrogen atom, an alkyl group, an alkoxyalkyl group, a cycloalkyl group, an allyl group, an aryl group which may be substituted, an aralkyl group, a furfuryl group, a tetrahydrofurfuryl group, or a hydroxyalkyl group.

2. The transfer sheet as claimed in claim 1, wherein in formula (I), X is a hydrogen atom or a bromine atom and $R^0$ is an alkyl group having from 4 to 12 carbon atoms.

3. The transfer sheet as claimed in claim 1, wherein in formula (I), X is a hydrogen atom and $R^0$ is an alkyl group having from 6 to 8 carbon atoms.

4. The transfer sheet as claimed in claim 1, wherein in formula (II), Y is a hydrogen atom or a bromine atom and $R^1$ and $R^2$ are a hydrogen atom or an alkyl group having from 1 to 8 carbon atoms.

5. The transfer sheet as claimed in claim 1, wherein in formula (II), Y is a hydrogen atom or a bromine atom and $R^1$ and $R^2$ are an alkyl group having from 1 to 4 carbon atoms.

6. The transfer sheet as claimed in claim 1, wherein in formula II , Y is a hydrogen atom and $R^1$ and $R^2$ are an alkyl group having 3 to 4 carbon atoms.

7. The transfer sheet as claimed in claim 1, wherein the color material layer contains the quinophthalone series dye of formula (I) in which X is a hydrogen atom or a bromine atom and $R^0$ is an alkyl group having from 4 to 12 carbon atoms and the quinophthalone series dye of formula (II) in which Y is a hydrogen atom or a bromine atom and $R^1$ and $R^2$ are an alkyl group having from 1 to 8 carbon atoms.

8. The transfer sheet as claimed in claim 7, wherein X is a hydrogen atom, $R^0$ is an alkyl group having from 6 to 8 carbon atoms, Y represents a hydrogen atom or a bromine atom, and $R^1$ and $R^2$ are an alkyl group having from 1 to 4 carbon atoms.

9. The transfer sheet as claimed in claim 8, wherein Y represents a bromine atom and $R^1$ and $R^2$ are an alkyl group having 3 or 4 carbon atoms.

10. The transfer sheet as claimed in claim 1, wherein the base film is a polyethylene terephthalate film.

11. The transfer sheet as claimed in claim 1, wherein the thickness of the base film is from 3 μm to 50 μm.

12. The transfer sheet as claimed in claim 1, wherein the thickness of the color material layer is from 0.1 μm to 5 μm.

13. The transfer sheet as claimed in claim 1, wherein the binder is selected from a cellulose series resin, an acrylic acid series resin and a starch series resin each being soluble in water.

14. The transfer sheet as claimed in claim 1, wherein the binder is selected from an acrilic resin a methacrylic resin, polystyrene, polycarbonate, polysulfone, polyether sulfone, polyvinylbutyral, ethyl cellulose, acetylpropionyl cellulose, acetyl cellulose, an AS resin, an ABS resin, a polyester resin, and a phenoxy resin each being soluble in organic solvent.

* * * * *